US005767435A

United States Patent [19]

Reymann

[11] Patent Number: 5,767,435

[45] Date of Patent: Jun. 16, 1998

[54] SPLINTERPROOF LINING FOR ARMOURED VEHICLES

[75] Inventor: Jean-Jacques Reymann, Tarbes, France

[73] Assignee: Giat Industries, Versailles, France

[21] Appl. No.: 676,339

[22] PCT Filed: Nov. 27, 1995

[86] PCT No.: PCT/FR95/01557

§ 371 Date: Jul. 19, 1996

§ 102(e) Date: Jul. 19, 1996

[87] PCT Pub. No.: WO96/17219

PCT Pub. Date: Jun. 6, 1996

[30] Foreign Application Priority Data

Nov. 30, 1994 [FR] France ..... 94 14343

[51] Int. Cl.[6] ..... F41H 7/04

[52] U.S. Cl. ..... 89/36.02; 109/80

[58] Field of Search ..... 89/36.02, 36.03; 109/80, 82, 83, 84, 49.5; 428/911

[56] References Cited

U.S. PATENT DOCUMENTS

| | | | |
|---|---|---|---|
| 4,934,245 | 6/1990 | Musante et al. | 428/911 |
| 5,200,256 | 4/1993 | Dunbar | 89/36.01 |
| 5,402,703 | 4/1995 | Drotleff | 89/36.02 |
| 5,440,965 | 8/1995 | Cordova et al. | 89/36.02 |

FOREIGN PATENT DOCUMENTS

| | | | |
|---|---|---|---|
| A-0 588 212 | 3/1994 | European Pat. Off. . | |
| 2613823 | 10/1988 | France | 89/36.02 |
| 2277141 | 10/1994 | United Kingdom | 89/36.02 |
| WO 91/00490 | 1/1991 | WIPO . | |

*Primary Examiner*—Stephen M. Johnson
*Attorney, Agent, or Firm*—Oliff & Berridge, PLC

[57] ABSTRACT

The invention relates to a splinterproof lining for a structure, such as an armoured vehicle. The splinterproof lining comprises several layers. The splinterproof lining includes an adhesive layer of solid organic material which is placed against a wall of the structure. The adhesive layer is between approximately 2 and 30 mm thick. An adjacent layer of a composite material with an organic matrix and a mineral or an organic reinforcement is placed in the immediate vicinity of the adhesive layer. The adjacent layer is approximately 5–30 mm thick. The splinterproof lining may also include a dispersion zone approximately 5 to 10 mm thick and filled with a polyurethane foam, with the dispersion zone placed between the adhesive layer and the adjacent layer. Additionally, an absorbing layer of double-drawn polyethylene approximately 5 mm thick, may be placed against the adjacent layer. In practice, the adhesive layer may be a first sub-layer of polyethylene approximately 15 mm thick and a second sub-layer of a composite material with an organic matrix, the second sub-layer being approximately 10 mm thick.

7 Claims, 1 Drawing Sheet

SPLINTERPROOF LINING FOR ARMOURED VEHICLES

BACKGROUND OF THE INVENTION

The technical scope of the present invention is that of splinterproof linings which are placed behind the wall of an armoured structure or vehicle so as to reduce its vulnerability.

Splinterproof linings are mostly used today in armoured troop transport vehicles or infantry combat vehicles. Their purpose is to reduce the angle of the splinter cone generated when the vehicle's armour is pierced by an anti-tank projectile of the kinetic-energy (discarding-sabot) or especially shaped charge dart type. Given the technical scope under consideration, it is easy to understand that there is little bibliographical data describing these linings.

However, it is known that a composite panel with organic matrix and fibres (aramid or polyethylene) or mineral fibres (glass) at a distance of 100 to 360 mm approximately from the inner wall of the vehicle. The main disadvantage of this solution lies in its relatively large bulk which causes a substantial decrease in the inner volume of the vehicle.

Another technology is also known which consists in placing a plate, approximately 50 mm thick, of solid organic material (polyethylene, for example) against the inner wall of the vehicle, which partly absorbs the splinters produced by the wall. However, it generates, when attacked, secondary splinters which are undetectable in the human body by X-ray.

U.S. Pat. No. 5,200,256 is known disclosing a multi-layer laser assembly designed to stop projectiles from small or medium calibres fire arms made up of a first layer of steel, followed by a layer of composite material, a metal mesh and lastly a layer of foam applied onto the structure. This lining is placed outside the structure and forms the armour plating itself and not a splinterproof lining.

Patent WO-A-91 00490 is also known disclosing a multi-layer assembly which is also designed to stop small and medium calibre projectiles in a similar way to the previous patent.

Patent EP-A-0 588 212 is also known relating to a solid type splinterproof lining, placed, as in the invention, against the inner wall of a structure. The lining described comprises, however, several layers made from the same constitutive materials, i.e. an organic matrix in which tungsten particles are incorporated. The impact impedence provided by the layers gradually decreases, in other words the under-layer placed against the structure has a high value near to that of the structure itself.

SUMMARY OF THE INVENTION

The aim of the present invention is to propose a light weight splinterproof lining which is as effective as solid linings but which is considerably thinner by using materials having a much lower density than metals.

The subject of the invention is thus a splinterproof lining for an armoured vehicle notably comprising a adhesive layer of solid organic material placed against the inner wall of the vehicle, characterised in that it comprises an adjacent layer made of a composite material with organic matrix and mineral or organic reinforcement placed in the immediate vicinity of the adhesive layer and between approximately 2 and 30 mm thick.

According to one characteristic of the invention, the adhesive layer of solid organic material is chosen from the group made up of polyethylene, polypropylene, a plate of polyethylene or aramid filaments, a rubber, and is between approximately 2 and 45 mm thick.

According to another characteristic of the invention, the splinterproof lining comprises an absorbing layer of particles chosen from the group made up of a composite material with organic matrix and binder and a plastic film and is between approximately 1 and 5 mm thick.

According to one embodiment of the invention, a dispersion zone between approximately 2 and 30 mm thick filled with a liquid or gaseous fluid, or a polystyrene or polyurethane foam is placed between the adhesive layer and the adjacent layer.

According to a preferred embodiment of the invention, the splinterproof lining comprises:

- an adhesive layer of polyethylene approximately 25 mm thick,
- a dispersion zone approximately 10 mm thick, and
- an adjacent layer made of a composite material with organic matrix reinforced by glass fibres, approximately 30 mm thick, and
- an absorbing layer of double-drawn polyethylene approximately 2 mm thick.

According to a second embodiment of the invention, the splinterproof lining comprises:

- an adhesive layer of polyethylene approximately 30 mm thick,
- an adjacent layer made of a composite material with organic matrix reinforced by glass fibres, approximately 35 mm thick, and
- an absorbing layer of double-drawn polyethylene 5 mm thick.

According to another embodiment, the splinterproof lining comprises:

- an adhesive layer formed of a first sub-layer of polyethylene approximately 15 mm thick and a second sub-layer of a composite material with organic matrix approximately 10 mm thick,
- a dispersion zone approximately 10 mm thick filled with polyurethane foam,
- an adjacent layer of composite material with organic matrix reinforced by glass fibres approximately 35 mm thick, and
- an absorbing layer of double-drawn polyethylene approximately 5 mm thick.

An advantage of the invention lies in the absorption of splinters generated during piercing of the vehicle wall without the generation of secondary splinters and the simultaneous reduction or total elimination of the phenomenon of scaling produced on the structure face opposite the one being attacked.

Another advantage lies in the decrease in bulk of the lining inside the vehicle.

Another advantage lies in the capacity of the lining according to the invention to reduce the neutron flux from a nuclear weapon. Yet another advantage lies in the capacity of the lining to absorb the thermal flux transmitted by the splinters of the projectile brought to a high temperature in itself, thereby ensuring a flame-retarding effect.

BRIEF DESCRIPTION OF THE DRAWINGS

Other characteristics and advantages of the invention will become apparent from reading the additional description given hereafter by way of illustration and with reference to an appended drawing in which FIGS. 1–3 show structures of the wall of an armoured vehicle or other structure.

DETAILED DESCRIPTION OF THE PREFERRED EMBODIMENT

Figure 1:
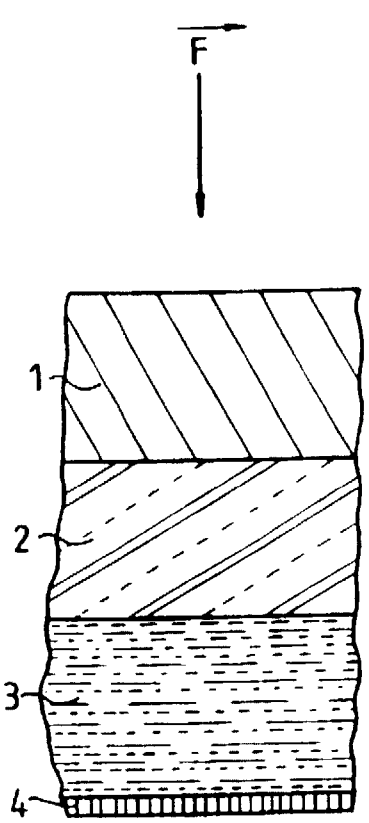

In FIG. 1, the wall 1 of an armoured vehicle or other structure is shown in a cross-sectional view, the vehicle generating splinters when damaged by a projectile coming from the outside symbolised by arrow F. A first adhesive layer 2 is placed behind this wall 1, in other words on its inside, made up of a known material chosen from the group made up of polyethylene, polypropylene, a plate of polyethylene or aramid filaments, a rubber. The adhesion may, for example, be made by bonding using a glue or by bolting. The thickness of this layer 2 is advantageously between 5 and 45 mm. The purpose of this layer, because of the particular thickness selected, is to reduce and/or stop the large splinters produced behind the wall 1 and to obtain a first reduction of the dispersion angle of the splinters from this armoured wall. If need be, this layer 2 ensures a decrease in the neutron flux inside the vehicle in the event of nuclear attack. When the layer 2 is in the form of a plate of organic filaments of polyethylene or aramid, the large capacity of this material to deform dynamically is relied on.

This first layer is followed by an adjacent layer 3 which, combined with the layer 2, stops the secondary splinters generated by the first layer and further reduces the dispersion angle of the splinters from the armour wall 1. This layer 3 is made up of a composite material with organic matrix and mineral reinforcement between approximately 5 and 30 mm thick. The combined effects of layers 2 and 3 provide, with a substantially reduced thickness, an equivalent or greater effectiveness than that of each layer taken separately, but with a much greater bulk.

The effectiveness of these two layers 2 and 3 is completed by a third layer 4, referred to as the absorbing layer, to restrict the projection of microparticles of glass, which are harmful to the human organism, inside the vehicle after piercing layer 1. This layer 4 is made up of composite materials with organic matrix and organic binder and/or a plastic film having high mechanical properties such as double-drawn polyethylene. The thickness of the layer 4 is much reduced in comparison to that of the two others, for example between about 1 and 5 mm. This layer 4 is applied, for example by bonding, onto layer 3.

The performances of the splinterproof lining according to the invention can be further improved by spacing layers 2 and 3 apart so as to create a dispersion zone for the splinters. This layer 5 can be of a gas or liquid, or a polystyrene or polyurethane foam and is, between approximately 5 and 30 mm thick. The presence of this layer 5 is conditioned by the threat level which is required to be reduced.

By way of illustration, the two followings configurations have been produced:

| | Lining a | Lining b |
|---|---|---|
| layer 2 | 25 mm | 30 mm |
| layer 5 | 10 mm | 0 |
| layer 3 | 30 mm | 35 mm |
| layer 4 | 2 mm | 5 mm |

Armour piercing trials using large calibre hollow charge projectiles were able to prove that lining a of a thickness of 67 mm and lining b of a thickness of 70 mm were equally effective as known, much bulkier linings in accordance with required performances.

Figure 3:
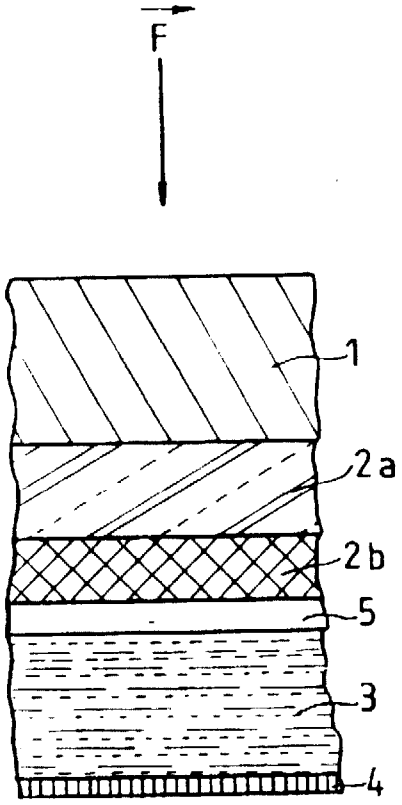
FIGS. 1 to 3 are section views of the lining according to the invention.
Figure 2:
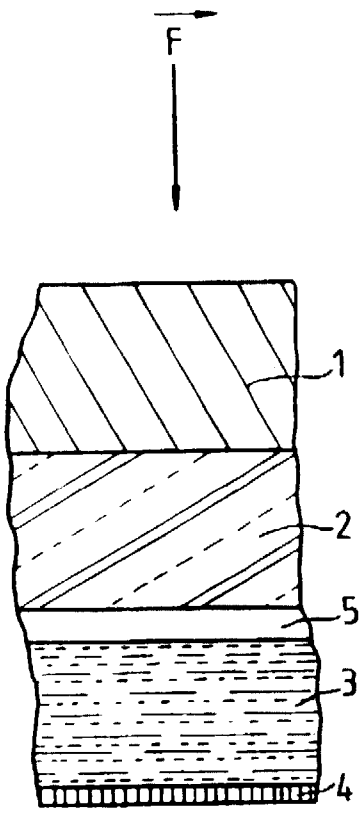

FIG. 3 shows an alternative embodiment of the splinterproof lining in which the layer 2 is replaced by two sub-layers 2*a* and 2*b*. The sub-layer 2*a* is of the same type as the original layer 2, i.e. it is made up of polyethylene, polypropylene, a plate of polyethylene or aramid filaments, a rubber. This material provides good impact impedence. It can be between about 2 and 30 mm thick. The sub-layer 2*b* is made up of a composite with organic matrix and mineral or organic fibre reinforcements. This layer 2*b* is approximately 2 to 20 mm thick. The layer 5 which forms a dispersion zone can be made up of a polystyrene or polyurethane foam. The other two layers 3 and 4 are identical to those described previously.

By way of illustration, a splinterproof lining has been produced comprising:

layer 2*a*:15 mm rubber layer 2*b*:10 mm composite material layer 5:10 mm polyurethane foam layer 3:30 mm composite material layer 4:2 mm double-drawn polyethylene.

Trials against piercing using shaped charges have proved the excellent properties of the splinterproof lining obtained.

Generally, the flame-retarding effect of the lining according to the invention can be observed, the lining not bursting into flame under the effects of the projectile's splinters which are brought to a high temperature. This technical effect is due to the absence of oxygen within the lining, to the specific selection of the type of layer and to the good adhesion between the layers.

What is claimed is:

1. A splinterproof lining for an armoured structure comprising:

an adhesive layer having a thickness between 2 and 45 mm placed against an inner wall of the armoured structure, the adhesive layer made of a material that is comprised only of a solid organic material;

an adjacent layer made of a composite material which comprises an organic matrix and a reinforcement, wherein the reinforcement comprises a mineral or an organic reinforcement, the adjacent layer placed adjacent to the adhesive layer, the adjacent layer being between 2 and 35 mm thick.

2. The splinterproof lining according to claim 1, wherein the solid organic material selected from the group consisting of a polyethylene, a polypropylene, a plate of polyethylene, a plate of aramid filaments, and a rubber.

3. The splinterproof lining according to claim 1, further comprising:

an absorbing layer made of a composite material which comprises an organic matrix, a binder and a plastic film, the absorbing layer being between 1 and 5 mm thick.

4. The splinterproof lining according to claim 3, wherein the adhesive layer is made of a polyethylene 30 mm thick, the adjacent layer is made of the composite material with the organic matrix reinforced by glass fibres, the adjacent layer being 35 mm thick, and the plastic film is made of a double-drawn polyethylene, the absorbing layer being 5 mm thick.

5. The splinterproof lining according to claim 1, further comprising:

a dispersion zone between 5 and 30 mm thick, the dispersion zone being filled with a material selected from the group consisting of a liquid, a gaseous fluid, a polystyrene and a polyurethane foam, the dispersion zone being placed between the adhesive layer and the adjacent layer.

6. The splinterproof lining according to claim 5, wherein the adhesive layer is made of a polyethylene 25 mm thick, the dispersion zone is 10 mm thick, the adjacent layer is made of the composite material with the organic matrix reinforced by glass fibres, the adjacent layer being 30 mm thick, and an absorbing layer is made of a double-drawn polyethylene, the absorbing layer being 2 mm thick.

7. The splinterproof lining according to claim 5, wherein the adhesive layer is made up of a first sub-layer of a polyethylene, the first sub-layer being 15 mm thick and a second sub-layer of a composite material with an organic matrix, the second sub-layer being 10 mm thick, the dispersion zone being 10 mm thick and filled with the polyurethane foam, the adjacent layer is made of the composite material with the organic matrix reinforced by glass fibres, the adjacent layer being 35 mm thick and an absorbing layer is made of the double-drawn polyethylene, the absorbing layer being 5 mm thick.

* * * * *